United States Patent [19]

DeSantis

[11] 4,347,051

[45] Aug. 31, 1982

[54] DIE AND PUNCH ASSEMBLY FOR COMPACTING POWDER MATERIAL

[75] Inventor: Raymond P. DeSantis, Royal Oak, Mich.

[73] Assignee: PTX-Dentronix, Inc., Lincoln Park, Mich.

[21] Appl. No.: 76,366

[22] Filed: Sep. 17, 1979

[51] Int. Cl.[2] ..... B30B 11/02

[52] U.S. Cl. ..... 425/78; 425/352; 425/193; 425/195

[58] Field of Search ..... 425/78, 352, 193, 195

[56] References Cited

U.S. PATENT DOCUMENTS

| | | | |
|---|---|---|---|
| 2,411,379 | 11/1946 | Langhammer | 425/78 |
| 2,481,232 | 9/1949 | Moore | 425/78 |
| 2,810,929 | 10/1957 | Willi | 425/78 |
| 3,524,220 | 8/1970 | Davison | 425/78 |
| 3,593,366 | 7/1971 | Smith | 425/78 |
| 4,053,267 | 10/1977 | DeSantis | 425/78 |

*Primary Examiner*—J. Howard Flint, Jr.
*Attorney, Agent, or Firm*—Hauke and Patalidis

[57] ABSTRACT

A unitary punch and die assembly for tooling a powder material compacting apparatus, or press, the assembly comprising a die plate mounted in the press table, which removably holds a die bushing clamped in position by a retainer collet provided with a peripheral thread and an internal thread. The retainer collet has an internal shoulder engaging a shoulder at the base of the die bushing, and a clamping ring threads on the internal thread of the collet for holding the die bushing in position within the collet. The peripheral thread of the collet engages the corresponding internal thread of a die spacer on which the die plate is mounted. By means of the retainer collet and the clamping ring, the die bushing surface may be adjusted flush with the surface of the die plate, without requiring grinding or lapping of the die bushing after assembly of the die bushing in the die plate.

11 Claims, 3 Drawing Figures

DIE AND PUNCH ASSEMBLY FOR COMPACTING POWDER MATERIAL

CROSS-REFERENCE TO RALATED PATENTS

The present application is an improvement on the punch and die assemblies for compacting powder material disclosed in and claimed in U.S. Pat. No. 4,053,267 assigned to the same assignee as the present application.

BACKGROUND OF THE INVENTION

The present invention relates to powder material compacting presses, more particularly to an improved die and punch assembly for powder compacting presses.

In powder compacting presses as disclosed in U.S. Pat. Nos. 3,328,840, 3,344,213, 3,328,842, 3,414,940, 3,561,054, 3,726,622, 3,741,697, 3,775,032, 3,805,370 and 3,822,974, all assigned to the same assignee as the present application, there are disclosed apparatus such as presses and tools for such presses for compacting powder material, such as powdered metal, ferrite, glass and other materials into diverse articles such as toroids, beads, pellets and the like. In the powder compacting apparatus disclosed in the aforementioned patents, the articles are formed in single or multi-cavity dies, in which reciprocable punches are disposed, by compaction of the powder material between the punch end face and an anvil displaceable over the die cavity so as to overlap the die cavity.

A work station positioner assembly, forming part of the press apparatus, is disposed angularly or linearly movable over the die plate and is provided with three separate or integral elements, a powder dispenser unit, an anvil and a pick-up head. The powder dispenser unit is first positioned over the die cavity to fill the die cavity with a predetermined amount of powder material. The dispenser unit is then removed from above the work station positioner assembly, and the anvil unit is in turn positioned over the die cavity and clamped in position. The punch is reciprocated upwardly in the die such as to compact the powder material between the punch end face and the anvil. The anvil is then unclamped from above the die cavity and replaced by the pick-up head as a result of further angular or linear motion of the work station positioner assembly. The punch is reciprocated upwardly so as to eject the compacted article from the die cavity into the pick-up head for transfer to a remote station, or, alternatively, for transfer to a collection station by subsequent motion of the work station positioner assembly.

By way of utilizing standardized punch and die assemblies in the form of interchangeable tool capsules, all adapted to be interchangeably mounted on the press table in an appropriate mounting aperture, with the die plate disposed in the mounting aperture and held therein by any convenient means such as by mounting bolts, the remaining of the tool capsule projecting below the press table, with the punch actuating mechanism of the press appropriately connected to the punch actuating plate portion of the tool capsule, it is a simple matter after a production run of a particular part to remove a tool capsule and replace it by another tool capsule for compacting a different part. With the exception of the die bushings, the punches, and the core rods, if any, all the other mechanical parts forming the tool capsule are subject to little or no wear. The die bushings, the punch and the core rods, if any, are, however, subject to important load stresses and to wear, as a result of which they may experience dimensional changes, such as a progressive opening of tolerances and, if subjected to abnormal loads, they may be damaged beyond repair or even break. It is therefore convenient for the user to provide a tool capsule which can be easily dismantled and which provides easy removal of the die bushings, punches and core rods, when they become worn or when they break, for replacement by new die bushings, punches and core rods. It is also desirable that replacement die bushings, punches and core rods be reinserted in the tool capsule without too much fuss, without requiring complicated fixtures and gauges, and that the diverse replacement elements be held securely in position in proper alignment, as lack of alignment and incorrect positioning may result in breakage or in obtaining finished parts not conforming to specifications.

SUMMARY OF THE INVENTION

The present invention provides a punch and die assembly, or tool capsule, for powder material compacting presses, with convenient means for removably holding the perishable tool portions of the assembly such as to provide convenient replacement when such perishable tool portions, such as the die bushings, the punches and the core rods, if any, become unserviceable. More particularly, the present invention provides means for holding the die bushing, or bushings, in the die plate by means of a threaded retainer collet provided with a peripheral thread, preferably of the buttress type engaged with the die bushing support block, such that the die bushing is held securely in position by the retainer collet, in perfect alignment with respect to the punch axis, without shims, gauging or special precautions, and with the surface of the die bushing flush with the surface of the die plate.

A better understanding of the present invention which is an improvement on the structure disclosed in U.S. Pat. No. 4,053,267, will be had by those skilled in the art when the following description of the best mode contemplated for practicing the invention is read in conjunction with the drawings wherein:

DETAILED DESCRIPTION OF THE PREFERRED EMBODIMENT

Figure 1:
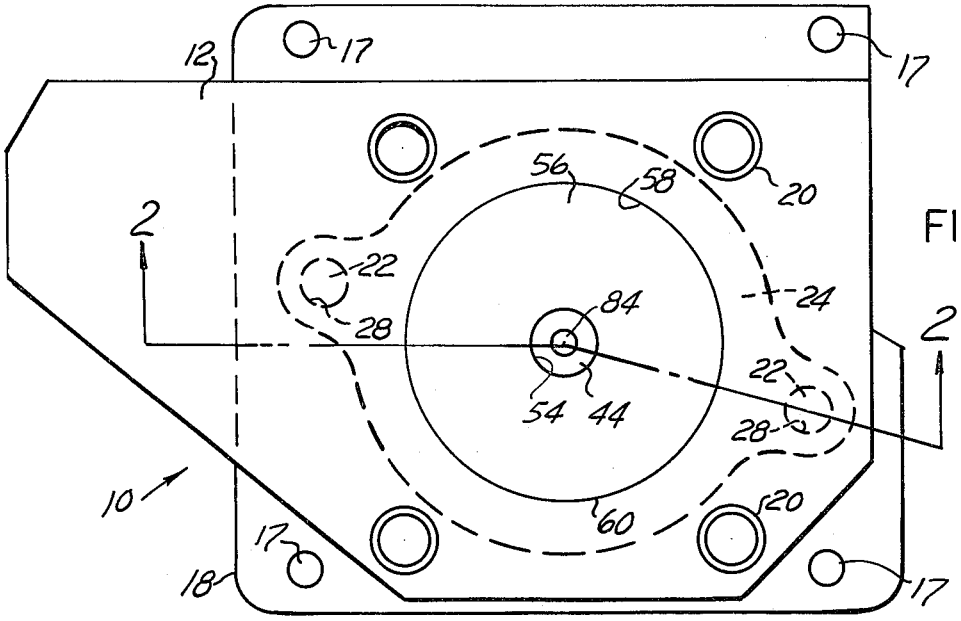
FIG. 1 is a top plan view of a punch and die assembly, or tool capsule, according to the present invention.
Figure 2:
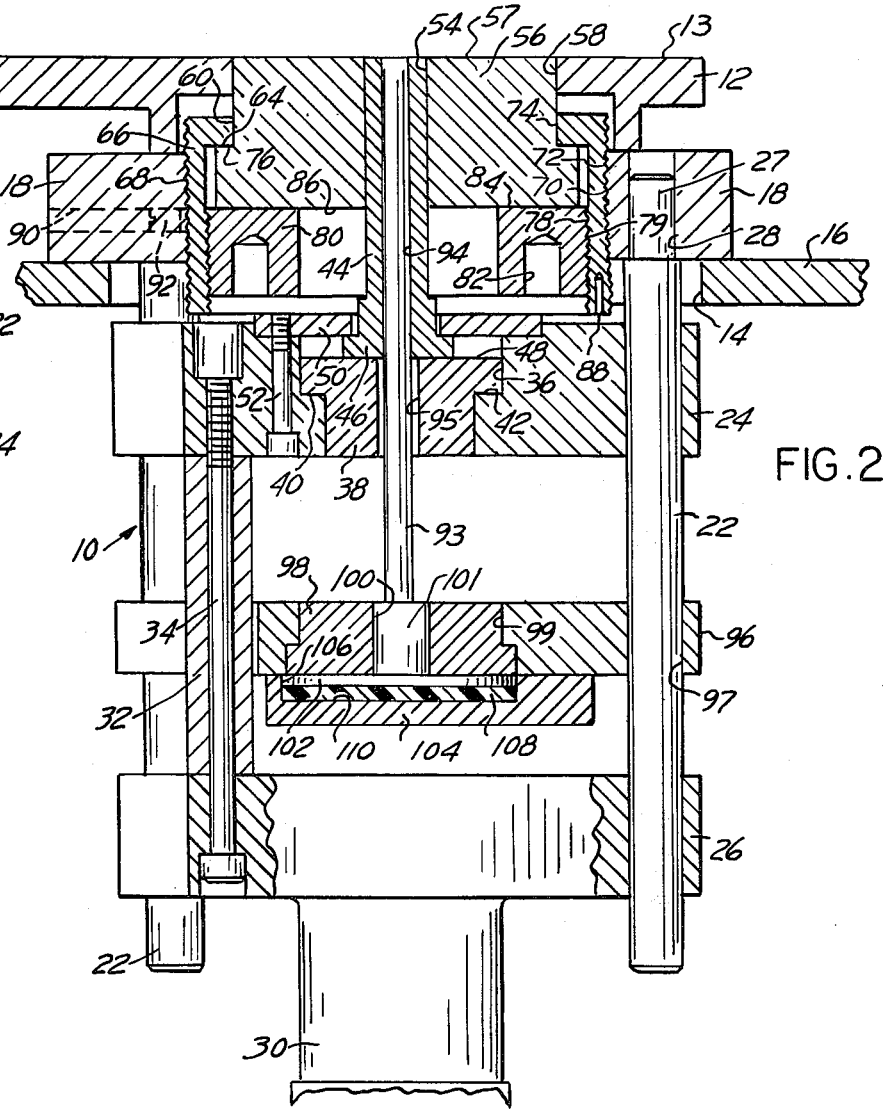
FIG. 2 is a sectional view along line 2—2 of FIG. 1.

Referring now to FIGS. 1–2, and more particularly to FIG. 2, a punch and die assembly, or tool capsule 10, according to the present invention, comprises a die plate 12 having a surface 13. The die plate 12 is adapted for mounting in an aperture 14 in the table 16, FIG. 2, of a powder compacting apparatus, or press (not shown), for example by means of bolts or other holding means, not shown, passed through mounting holes 17 in a die plate spacer 18. The die plate spacer 18 is mounted below the die plate 12 and attached to the die plate 12 by means of countersunk screws 20 (FIG. 1). Alternatively, the die plate 12 and the die plate spacer 18 may be made integral. At least one guidepost 22, and preferably a pair of guideposts 22, extending parallel to each other and perpendicular to the die plate 12, slidably support and guide a punch support upper plate 24 and a punch actuating lower plate 26, disposed parallel to each other and in a spaced apart relationship. The guideposts 22 are fixedly supported by the die plate spacer member 18 as a result of an end 27 of each guidepost 22 being press fitted in a bore 28 in the die plate spacer member 18. Radially disposed set screws, not shown, may be used to further secure the end of the guideposts 22 in the bore 28.

The punch actuating lower plate 26 is provided with a downwardly projecting integral portion 30 for coupling to the reciprocal ram of the press, not shown. The punch actuating lower plate 26 and the punch support upper plate 24 are interconnected by means of a pair of vertically disposed spacer sleeves 32, a threaded connecting rod 34 being disposed within each sleeve 32, such as to rigidly interconnect the punch actuating lower plate 26 and the punch support upper plate 24, which are thus reciprocable in unison.

The punch support upper plate 24 has an axially disposed stepped bore 36, having its larger diameter portion disposed toward the die plate spacer member 18. A punch support insert 38 is disposed in the stepped bore 36, the punch support insert 38 having an annular step portion 40 engaged with the annular step portion 42 of the bore 36. A punch member 44 has an enlarged foot portion 46, engaged with the upper face 48 of the punch support insert 38, which is held in position above the punch support insert 38 by means of a clamping plate, or retainer 50 held by clamping screws 52. The upper free end of the punch 44 is engaged in the bore 54 of a die bushing 56, having an end surface 57, which is disposed in an aperture or bore 58 formed in the die plate 12. The die bushing 56 has a reduced diameter portion 60 which fits in the bore 58 of the die plate 12, and an enlarged diameter portion 62, an external flat annular shoulder 64 being formed between the enlarged diameter portion 62 and the reduced diameter portion 60 of the die bushing 56. A die bushing retainer collet 66, in the form of a sleeve, is provided on its peripheral surface with a thread 68 engaging the internal thread 70 of a corresponding bore 72 disposed in the die spacer plate 18. The top of the retainer collet 66 is provided with a reduced internal diameter portion 74 fitting the reduced diameter portion 60 of the die bushing 56, and forming an internal flat annular shoulder 76 engaged with the external annular shoulder 64 of the die bushing 56. The retainer collet 66 has an internal thread 78 proximate its other end which accepts the peripheral thread 79 of a clamping ring 80. When the clamping ring 80 is threaded by means of a spanner wrench engaging the driving bores 82, the annular end surface 84 of the clamping ring 80 engages the lower face 86 of the die bushing 56, thus drawing the annular shoulder surfaces 64 and 76 of the die bushing 56 and retainer collet 66, respectively, in mutual engagement. The vertical position of the retainer collet 66 is adjustable with precision by rotating the retainer collet 66 relative to the die plate spacer 18, and thus threading in and out of the die plate spacer bore 72, by means of a spanner wrench having pins projecting in the driving recesses 88 of the retainer collet 66. Once a correct position of the retainer collet 66 is achieved, the retainer collet 66 may be locked in position by means of set screws 92 disposed in radial threaded bores 90 in the die spacer 18. The end of the set screws 92 is preferably provided with a nylon or delron insert to prevent distorting the peripheral thread 68 of the retainer collet 66.

It can thus be seen that the vertical position of the die bushing 56 may be adjusted with precision, without requiring the use of shims, to ensure that the upper face 57 of the die bushing 56 is flush with the surface 13 of the die plate 12. As the adjustment provided by rotating the retainer collet 66 a few degrees in a direction or another results in a very precise infinitesimal motion of the die bushing 56, such as adjustment may be made with great precision, and there is no requirement for the end surface 57 of the die bushing 56 to be ground or lapped flush with the surface 13 of the die plate 12.

In the structure illustrated in the drawings in which the tool capsule 10 is also provided with core rods, such as core rod 93 having an end projecting through an axial bore 94 in the punch 44 and an aligned axial bore 95 in the punch support insert 38, the assembly also comprises a core rod support plate 96 adjustably mounted on the guideposts 22 between the plates 24 and 26 by means of parallel bores 97 each affording passage to one of the guideposts 22, appropriate set screws, not shown, being radially disposed in the core rod support plate 96 for immobilizing the core rod support plate 96 relative to the guideposts 22 in an appropriate fixed position. The core rod support plate 96 has a stepped insert 98 disposed in a stepped bore 99 in the core rod support plate 96, the insert 98 being provided with an axial bore 100 accepting, with clearance, the body 101 of the core rod 93.

The core rod 93 is provided with an enlarged foot portion 102 which, after the core rod 93 has been inserted through the bore 100 of the insert 98, engages the lower surface of the insert 98. The core rod 93 is held in position in the core rod support plate 96 by means of a clamp plate 104, held in position by convenient means such as screws or bolts, not shown, and provided with a recess 106 accepting the enlarged foot portion 102 of the core rod 93, a resilient washer or disc 108 made of preferably a resilient plastic material such as nylon or the like being disposed between the end face of the enlarged foot portion 102 of the core rod and the bottom surface 110 of the recess 106, for the purpose of compensating for any misalignment which may cause the core rod to bind in the bore 94 in the punch 44, and of cushioning any shock or abnormal load that could cause breakage of the core rod 93.

Figure 3:
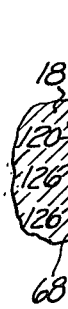
FIG. 3 is a detailed schematic view of the buttress type thread preferably used for removably holding the die retainer collet in the die mount of the tool capsule of FIG. 1.

Referring now to FIG. 3, there is illustrated in detail the preferred configuration of the conforming and engaged threads of the threaded bore 72 in the die plate spacer 18 and the peripheral thread 68 on the die bushing retainer collet 66. The preferred type of screw thread used is a modified buttress type thread wherein the driving face 120 of the thread is disposed at an angle a of substantially 7° relative to an imaginary plane 122 perpendicular to the axis 124 of the screw thread. The idle side of the screw thread, designated by numeral 126, is disposed at an angle b to the imaginary plane 122, the angle b being substantially equal to 45°. The top of the male thread 68 is truncated as shown at 126, to provide adequate clearance between the top of the male thread 68 on the periphery of the retainer collet 66 and the bottom of the internal thread 70 in the die plate spacer member 18.

The advantages provided by utilizing such a modified buttress thread form are many as compared to, for example, conventional 60° V-threads. With a conventional 60° V-thread, any lateral displacement of the die bushing retainer collet 66 relative to the axis of the screw thread causes the retainer collet annular shoulder surface 76 in engagement with the annular shoulder surface 64 of the die bushing 56 to no longer lie in a plane perpendicular to the axis of the screw thread 124, with the result that more pressure is applied by a side of the engaging annular shoulder surface 76 of the retainer collet 66 on an edge of the end annular shoulder surface 64 of the die bushing 56 than on the edge of the annular shoulder surface 64 at a point diametrically opposed, such that there results a tilting force being exerted upon the die bushing 56 which prevents the die bushing from remaining axially aligned when held in the mounting bore 58 in the die plate 12. With conventional V-threads, for every lateral displacement of the retainer collet 66 of a unit of length, there results an error in axial alignment of the die bushing amounting to one half that unit of length. By using the buttress type thread illustrated at FIG. 3, a lateral displacement of the die bushing retainer collet 66 relative to the die plate spacer member 18, due to normal play and manufacturing tolerance corresponding to a one unit of length, such as for example, 0.0001 in. results in a misalignment of the die bushing of 1/10 that value, or 0.00001 in. only.

The peripheral thread 79 of the clamping ring 80 and the internal thread 78 of the retainer collet 66 consist of a very fine thread, also preferably of the same modified buttress type.

Although the unitary punch and die assembly of the present invention has been illustrated and described as comprising a single die, a single punch and a single core rod, it will be readily apparent to those skilled in the art that the single die bushing may be provided with a plurality of longitudinal bores and the punch holder plate may be arranged to support a plurality of punches each having an end projecting in one of the bores in the die bushing, or in the alternative, each die bore may be in a separate die bushing, the plurality of die bushings being each supported in the die plate by way of the retainer arrangement hereinbefore described. It will also be readily apparent that the die plate 12 and the die plate spacer 18 may be made integral, resulting in the die plate spacer member being part of the die plate and the guideposts 22 being press fitted, or otherwise fastened, in bores formed in the die plate, perpendicular to the die plate surface and open to the bottom surface of the die plate.

The die plate 12, the die bushing 56, the punch 44 and the core rod 93 are preferably made of ultra-hard material such as a metallic carbide, tungsten carbide, for example. The other parts forming the die and punch assembly, or tool capsule 10, are made of steel.

Having thus described the present invention by way of a typical structural embodiment thereof, modifications whereof will be apparent to those skilled in the art, what is claimed as new is as follows:

I claim:

1. In a unitary punch and die assembly for mounting on a powder compacting press, said assembly comprising a die plate, a bore in said die plate and a removable die bushing disposed in said bore, a die bushing retainer collet in the form of a cylindrical sleeve member provided with a peripheral thread engageable with an internal thread formed in the bore in said die plate, a bore in said retainer collet having an enlarged diameter portion defining a stepped annular surface, said die bushing having a conforming configuration with a reduced diameter portion and a stepped annular surface engaged with said annular surface in said retainer collet bore, an internal thread in said enlarged diameter portion of said retainer collet bore and a ring member having a peripheral thread engageable with said internal thread and an end face engaged with an end of said die bushing for holding said die bushing in said retainer collet bore with said annular surfaces in mutual engagement.

2. The unitary punch and die assembly of claim 1 wherein said die bushing retainer collet peripheral thread has an assymetrical shape with the driving side of said thread forming an acute angle with a plane perpendicular to the axis of said thread.

3. The unitary punch and die assembly of claim 2 wherein the driving face of said peripheral thread on said retainer collet forms an angle of about 7° with said plane perpendicular to the axis of said thread.

4. The unitary punch and die assembly of claim 3 wherein the idle side of said peripheral thread on said retainer collet forms an angle of about 45° with said plane perpendicular to the axis of said thread.

5. The unitary punch and die assembly of claim 2 wherein said peripheral thread on said ring member has an assymetrical shape with the driving side of said thread forming an acute angle with a plane perpendicular to the axis of said thread.

6. The unitary punch and die assembly of claim 3 wherein the driving face of said peripheral thread on said ring member forms an angle of about 7° with said plane perpendicular to the axis of said thread.

7. The unitary punch and die assembly of claim 6 wherein the idle side of said thread forms an angle of about 45° with said plane perpendicular to the axis of said thread.

8. The unitary punch and die assembly of claim 1 further comprising at least one guidepost supported by said die plate and extending substantially parallel to the axis of said assembly, a pair of spaced apart plates slidably reciprocable in unison relative to said die plate and being supported and guided by said guidepost, a recess on one of said plates most proximate to said die plate, a punch member normally slidably engaged in a die bore in said die bushing and having an enlarged foot portion in said recess in said plate, means for clamping said punch on said plate, coupling means disposed below the other of said plates for connection to an actuating member dependent from said press and linking means interconnecting said plates for reciprocating said plates in unison.

9. The unitary punch and die assembly of claim 8 wherein said die plate comprises a die plate spacer mounted therebelow, said bore being disposed in said die plate spacer and said guidepost being supported by said die plate spacer.

10. The unitary punch and die assembly of claim 8 further comprising a core rod support plate adjustably supported by said guidepost and disposed between said spaced apart plates, said core rod support plate supporting a core rod having an end extending in a longitudinal bore in said punch.

11. The unitary punch and die assembly of claim 10 wherein said core rod has an enlarged foot portion disposed in a recess in said core rod support plate, a retainer member holding said core rod foot portion in said recess, and a resilient member being disposed between said enlarged foot portion and the surface of said recess.

* * * * *